US007000254B1

(12) United States Patent
Stanley

(10) Patent No.: US 7,000,254 B1
(45) Date of Patent: Feb. 21, 2006

(54) COSTUME CONSTRUCTION

(76) Inventor: Virgil E. Stanley, 5980 N. Michigan Rd., Indianapolis, IN (US) 48228

( * ) Notice: Subject to any disclaimer, the term of this patent is extended or adjusted under 35 U.S.C. 154(b) by 62 days.

(21) Appl. No.: 10/353,287

(22) Filed: Jan. 29, 2003

(51) Int. Cl.
*A41D 1/00* (2006.01)

(52) U.S. Cl. ..... 2/69

(58) Field of Classification Search ..... 2/69, 2/69.5, 92, 96, 215, 267, 272, 275, DIG. 3, 2/97, 108, 102, 94; D2/741
See application file for complete search history.

(56) References Cited

U.S. PATENT DOCUMENTS

| | | | | | |
|---|---|---|---|---|---|
| 395,189 | A | * | 12/1888 | Stanton | 2/1 |
| 2,428,198 | A | * | 9/1947 | Brohard, Jr. | 2/96 |
| 3,382,504 | A | * | 5/1968 | Barbosa | 2/80 |
| 4,154,183 | A | * | 5/1979 | Nunez | 2/302 |
| 4,261,059 | A | * | 4/1981 | Spitz | 2/108 |
| 4,310,927 | A | * | 1/1982 | DeBose | 2/115 |
| 4,316,287 | A | * | 2/1982 | Rule | 2/69.5 |
| 4,441,211 | A | * | 4/1984 | Donzis | 2/459 |
| 4,470,155 | A | * | 9/1984 | Maeshima | 2/108 |
| 4,502,154 | A | * | 3/1985 | Itoi | 2/108 |
| D285,815 | S | * | 9/1986 | Finn | D2/831 |
| 4,722,098 | A | * | 2/1988 | Stapleton | 2/69 |
| 5,079,778 | A | * | 1/1992 | Sloot | 2/69 |
| 5,421,045 | A | * | 6/1995 | Bowen | 5/485 |
| 5,442,818 | A | * | 8/1995 | Loos | 2/272 |
| 5,570,473 | A | * | 11/1996 | Andries | 2/93 |
| 5,643,037 | A | * | 7/1997 | Altschul | 446/28 |
| 5,713,079 | A | * | 2/1998 | Simon et al. | 2/243.1 |
| 5,742,939 | A | * | 4/1998 | Williams | 2/69 |
| 5,913,405 | A | * | 6/1999 | Bordier | 2/467 |
| 5,983,394 | A | * | 11/1999 | Joo | 2/113 |
| 6,041,436 | A | * | 3/2000 | Keen | 2/69 |
| 6,061,830 | A | * | 5/2000 | Geller | 2/69 |
| 6,112,327 | A | * | 9/2000 | Shaffer | 2/67 |
| 6,173,450 | B1 | * | 1/2001 | Hari | 2/69 |
| 6,256,790 | B1 | * | 7/2001 | Rankin | 2/102 |
| 6,314,580 | B1 | * | 11/2001 | Greenberg et al. | 2/108 |
| 6,343,968 | B1 | * | 2/2002 | Louie et al. | 446/72 |
| 6,357,049 | B1 | * | 3/2002 | Hoffman | 2/69 |
| 6,564,387 | B1 | * | 5/2003 | Willoughby | 2/69 |

* cited by examiner

*Primary Examiner*—Alissa L. Hoey
(74) *Attorney, Agent, or Firm*—Coats & Bennett, P.L.L.C.

(57) ABSTRACT

A costume adapted to be worn by a person and including a garment made up, in part at least, by a top that extends from the shoulder of the person downwardly to at least approximately the waist of the person. The garment includes an outer area that is provided with a costume design while the top includes an interior area. Suspended within the interior area of the top is a bag lining. Disposed within the bag lining is a stuffing material such that when the costume is worn by the person, the stuffing material imparts a plump or extraordinary rounded appearance to the costume. Further, the top of the costume includes a neck opening and a pair of side areas. There is provided a side opening that extends from the deck opening downwardly through one of the side areas. At least one fastener, such as a zipper, is associated with the side opening that permits the side opening to be easily opened and closed.

22 Claims, 6 Drawing Sheets

COSTUME CONSTRUCTION

FIELD OF THE INVENTION

The present invention relates to costumes and costume constructions.

BACKGROUND OF THE INVENTION

Many different costumes are known, particularly for use on special occasions such as Halloween or carnival festivals. In recent years, the demand for costumes, even for adult use, has increased along with the general increase in demand. Consumers have come to expect costumes that display outstanding originality. This is the case with children's costumes as well as other costumes that might be worn by adults at costume parties, carnivals, festivals, etc.

Designing costumes with great originality and which are effective in communicating a caricature or idea is quite difficult. For the most part, costumes are designed to be worn by a child or an adult. These costumes have to be designed around a person, that is, a child or an adult. Therefore, the costume designer is generally limited to a design that is adapted to be worn. Thus, there are built-in restraints to the design. Often, it is difficult to manifest the caricature or idea in a garment costume that is designed, for example, to be worn by a six-year old child. This is particularly true when attempting to develop a costume that requires substantial stature or size beyond the size of the intended user of the costume.

SUMMARY OF THE INVENTION

The present invention relates to a costume adapted to be worn by a person and includes a garment including a top that extends from the shoulders of the person downwardly to at least the waist of the person. The garment includes an outer area that is provided with a costume design. The top includes and interior area and disposed within the interior area of the top is a bag lining. Contained within the bag lining is stuffing material such that when the costume is worn, the stuffing material imparts a plump appearance to the costume.

In one particular embodiment, the garment of the costume includes a top and a bottom, and the bag lining, referred to above, is stitched into the top portion such that at least a portion of the bag lining hangs in a suspended manner within the interior of the top.

In another particular embodiment, the top includes a neck opening and a pair of arm openings and the bag lining is secured in the top by stitch segments that extend around the neck opening and the pair of arm openings.

Another aspect of the present invention deals with an opening provided in the costume for enabling a person to easily and conveniently slip into and out of the costume. In this regard, the top includes a pair of side areas and there is provided an access opening that extends downwardly from the neck opening through one side area of the top. Associated with the side opening is a fastener such as a zipper that permits the side opening to be easily and conveniently opened and closed.

Other objects and advantages of the present invention will become apparent and obvious from a study of the following description and the accompanying drawings, which are merely illustrative of such invention.

DESCRIPTION OF EXEMPLARY EMBODIMENT

Figure 1:
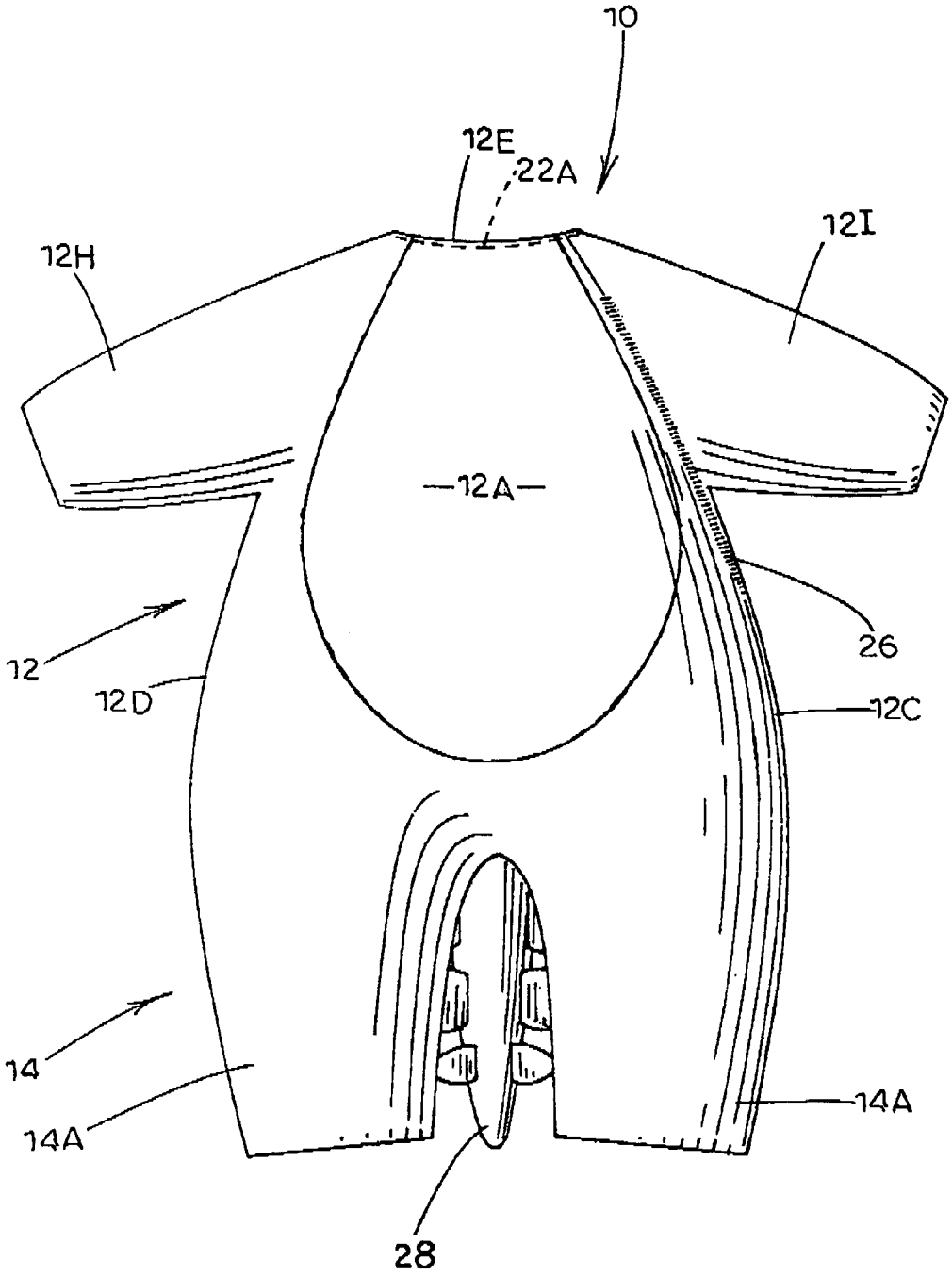
FIG. 1 is a front elevational view of the costume.

With further reference to the drawings, the costume of the present invention is shown therein and indicated generally by the numeral 10. Costume 10 is adapted to be worn by a person such as a child. In this regard, the drawings are presented in a manner that is intended to generally reflect the appearance of the costume 10 in a worn state.

In any event, costume 10 comprises a garment that in the case of the present embodiment includes a top indicated generally by the numeral 12 and a bottom indicated generally by the numeral 14. In this exemplary embodiment, the top 12 and bottom 14 are integral or formed into one piece. It will be appreciated that the top 12 and bottom 14 could possibly be in the form of two single pieces. Further, it should be appreciated that the costume could be formed by a garment that comprises substantially a top portion only, that is, a top that extends from the shoulders downwardly to approximately the waist area of a person when the costume is worn.

Turning to a more detailed description of the costume 10, and with reference to the top 12, it is seen that the top includes a front 12A and a back 12B. Extending between the front 12A and back 12B is a pair of side areas 12C and 12D. Formed in the top is a neck opening 12E and a pair of arm openings 12F and 12G. Further extending outwardly from the arm openings, is a pair of arms 12H and 121.

Figure 2:
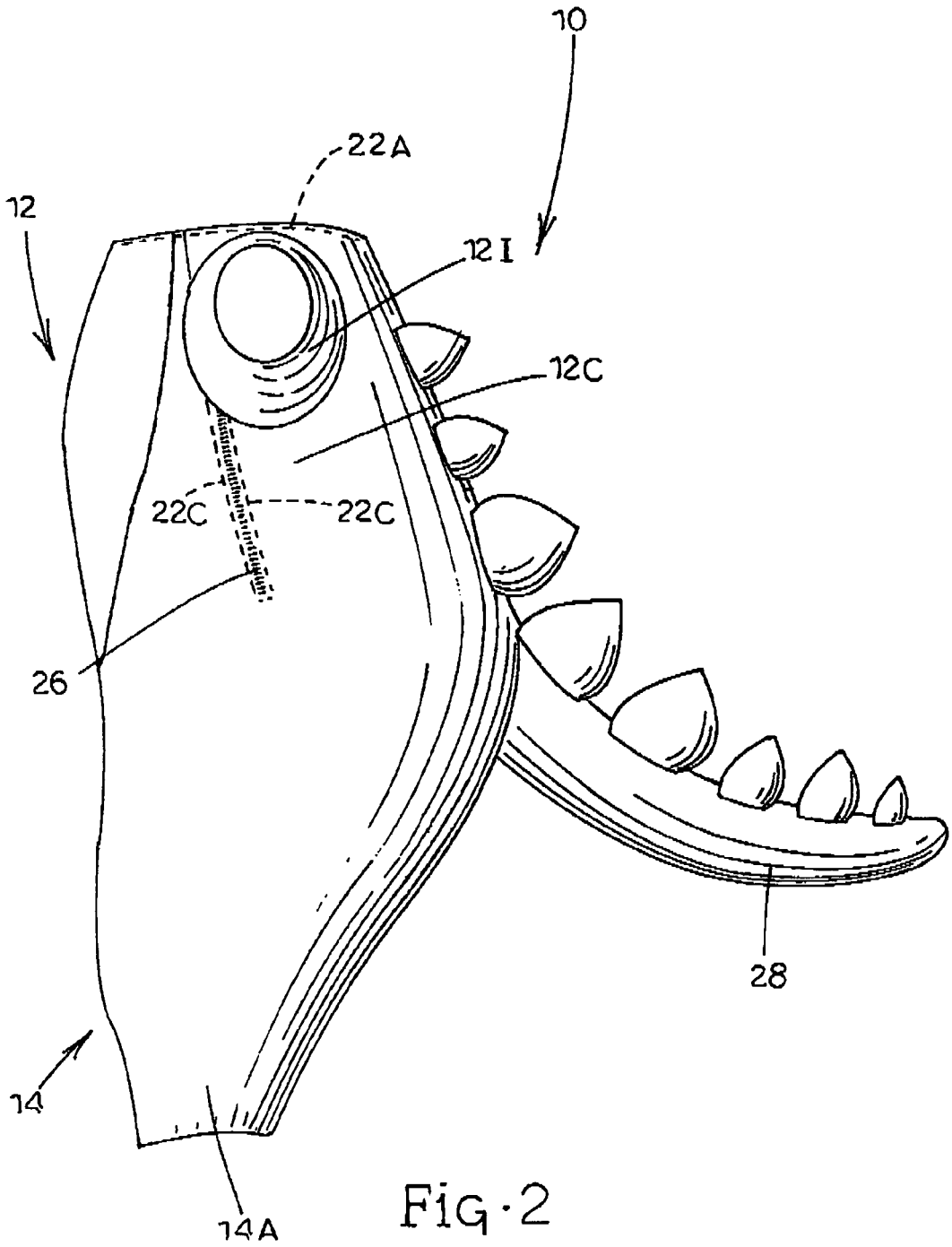
FIG. 2 is a side elevational view of one side of the costume.
Figure 3:
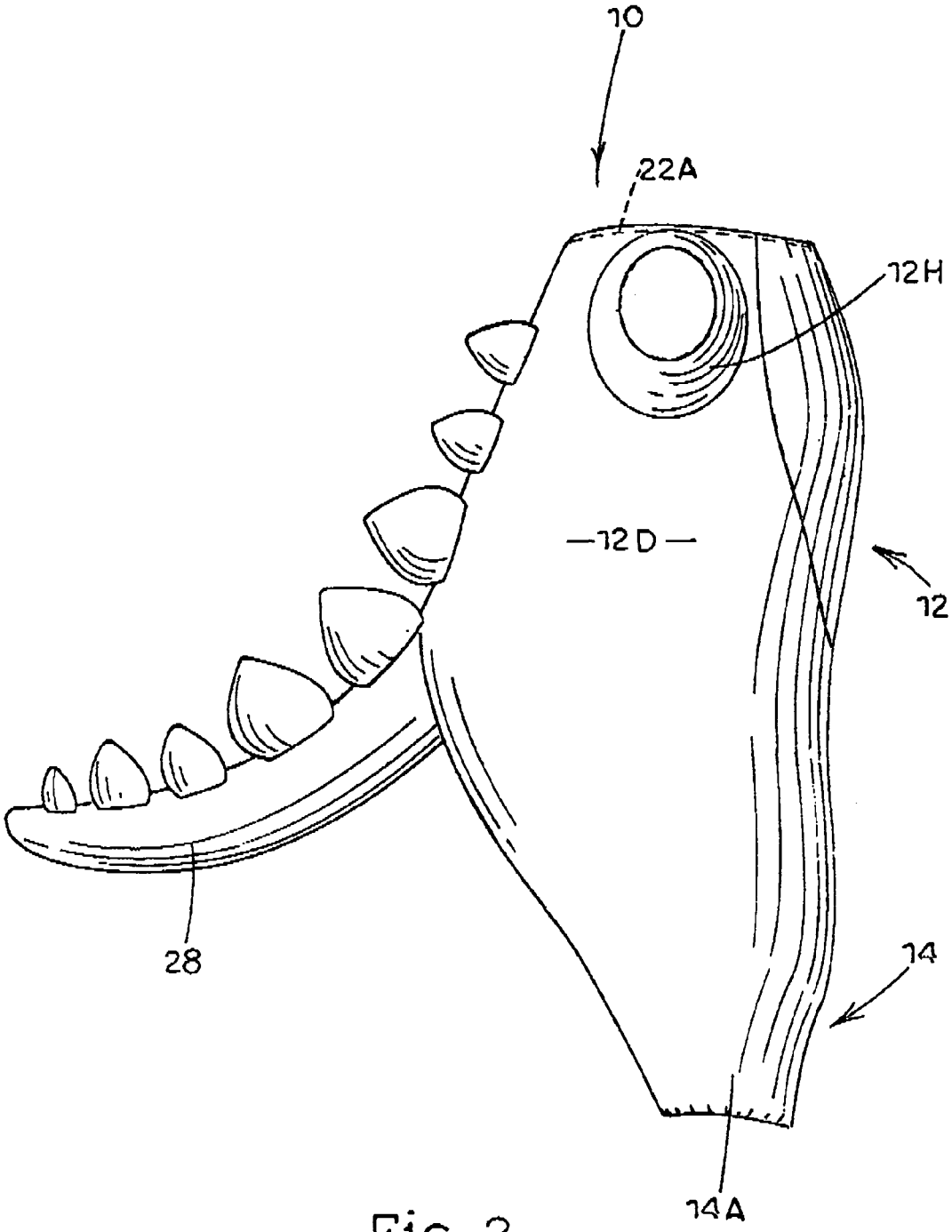
FIG. 3 is a side elevational view of the other side of the costume.
Figure 4:
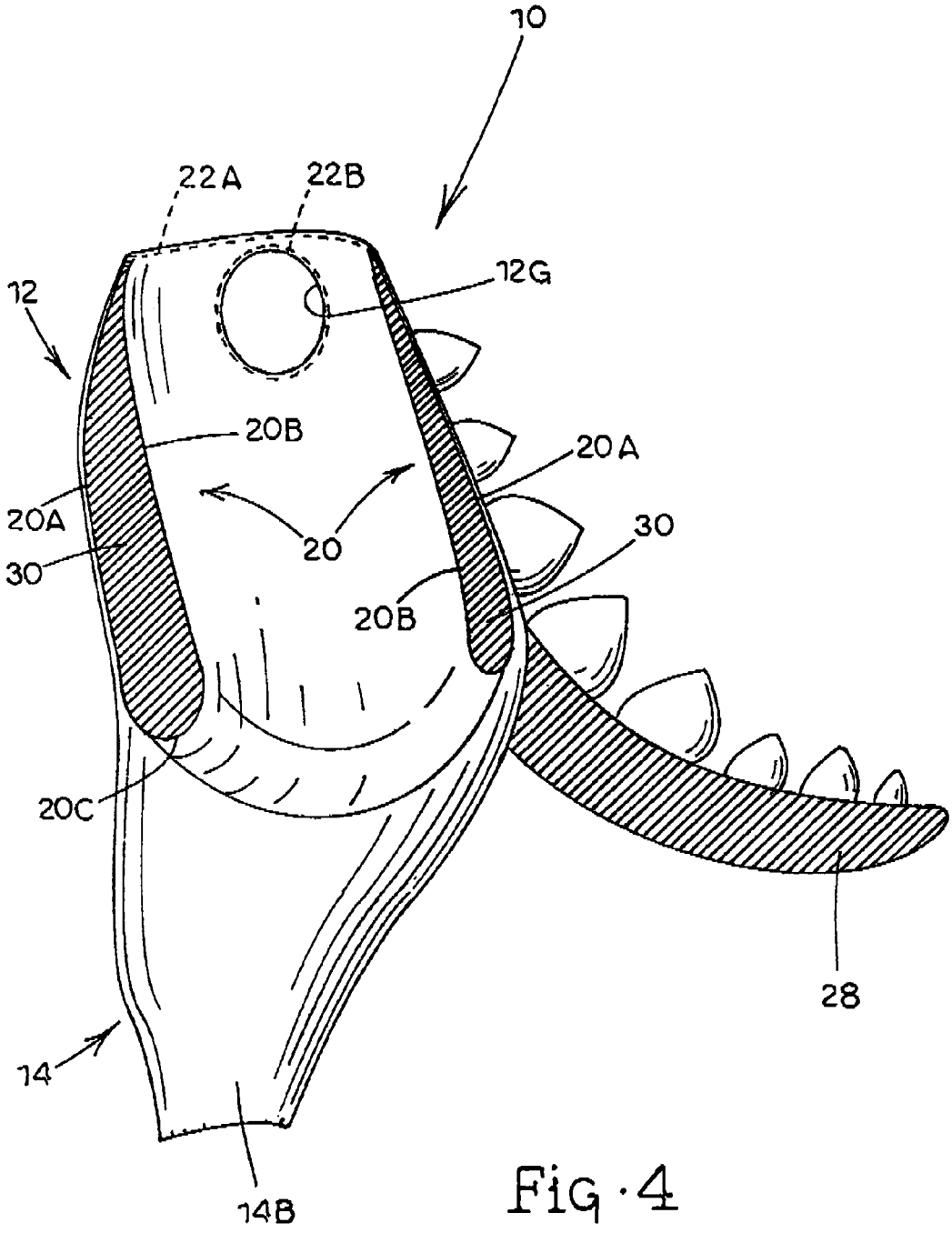
FIG. 4 is a longitudinal cross-sectional view of the costume showing one side of the costume.
Figure 5:
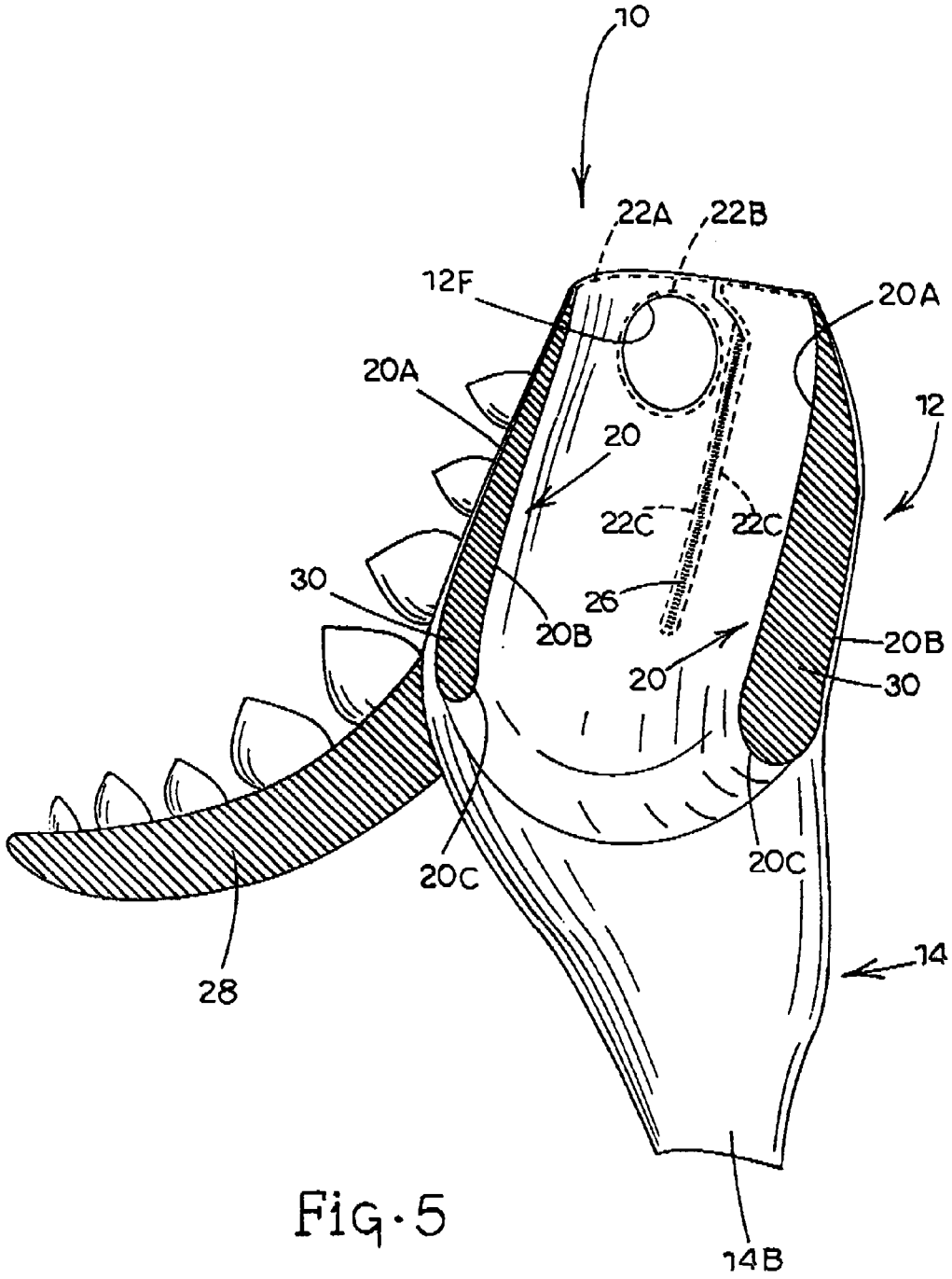
FIG. 5 is a longitudinal sectional view showing the other side of the costume.
Figure 6:
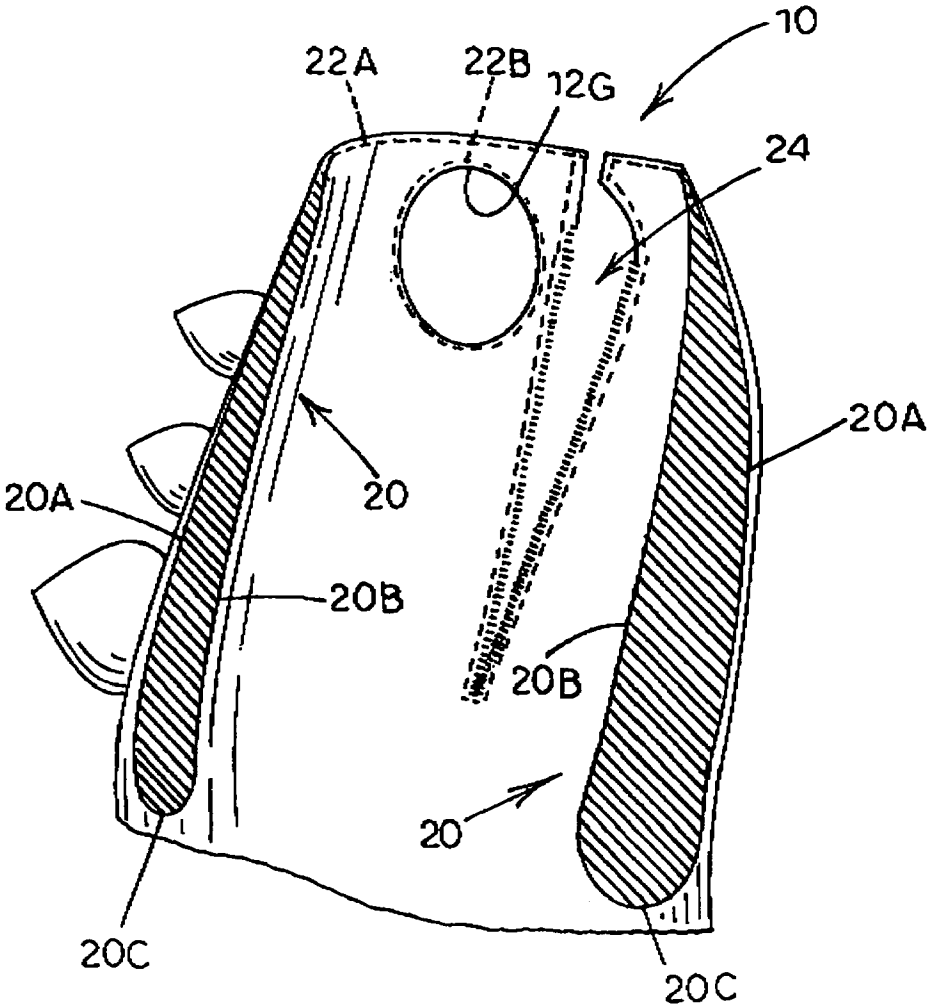
FIG. 6 is a fragmentary longitudinal sectional view similar to FIG. 5 but illustrating an opening extending down one side area of the costume.

Top 12 includes an outer area that is particularly seen in FIGS. 1–3 and an interior area, indicated generally by the numeral 16, that is shown in the sectional views of FIGS. 4–6.

In the case of the exemplary embodiment discussed herein, the bottom 14 assumes a form that includes a pair of legs 14A. Extending from the back of the costume is a tail 28.

In order to facilitate the adornment and removal of the costume 10 from a person, there is provided a side opening, indicated generally by the numeral 24, (FIG. 6) that extends downwardly from the neck opening 12E through at least a portion of one side area 12C or 12D. In the embodiment illustrated herein, side opening 24 extends downwardly through side area 12C just forwardly of the arm opening formed in that side of the costume. Associated with the side opening 24 is one or more fasteners that function to open and close the side opening 24. In this embodiment, the fastener is in the form of a zipper 26. Zipper 26 can extend from the lower portion of the opening 24 upwardly to the neck opening 12E. However, in this particular embodiment, it is contemplated that the zipper 26 will terminate just short of the neck opening 12E. To close the portion of the side opening 24 that exists between the neck opening 12E and the upper end of the zipper 26, there is provided one or more conventional garment catches (not shown).

Formed about the outer surface or outer area of the top 12 and bottom 14 is a costume design. The costume design is imparted to the top 12 and bottom 14 in the form of a particular shape, size, colors or features that give rise to an animal, caricature, etc. In the case of the embodiment illustrated herein, the costume 10 is in the form of a dinosaur. But it is appreciated that the costume could assume the form of various animals, both real and fanciful, and other caricatures without departing from the present invention.

Now turning to FIGS. 4–6, it is seen that the costume 10 is equipped with a feature that provides shape and caricature to the costume as a whole, and particularly to the upper portion of a costume. In this case, the costume 10 is provided with a bag lining indicated generally by the numeral 20. Bag lining 20 is secured or suspended from the interior 16 of the top 12. It is of a general two-ply construction and includes an outside ply 20A and an inside ply 20B. As viewed in FIGS. 4 and 5, the two-plies 20A and 20B come together at the bottom of the bag lining 20 to form a bottom or trough of 20C.

Bag lining 20 is stitched into the top 12 of the costume. It is stitched in several distinct areas. First, the bag lining 20 is secured around the neck opening 12E by a stitch segment 22A. Next the bag lining 20 is secured around each arm opening 12F and 12G by a pair of separate stitch segments 22B. Finally, in the case of this embodiment, the bag lining is secured along areas adjacent the side opening 24. That is, as viewed in FIG. 5, there is provided a pair of stitch segments 22C that are formed on opposite sides of the side opening 24 or zipper 26. These stitch segments 22C secure the bag lining to the interior of the top 12 adjacent the side openings 24.

In order to give the costume 10 a plump or robust appearance, the bag lining 20 contains or is stuffed with a soft stuffing material indicated by the numeral 30. This soft stuffing material can comprise various conventional filler material such as a fiber product, cotton, foam particles, etc. Once contained within the bag lining 20, the stuffing material 30 adds additional thickness to the costume especially about the top 12. Further, while the bag lining 20 is amply secured to particular interior areas of the top 12, it is seen that certain portions of the bag lining are simply suspended in the interior of the top 12. This, of course, enables the stuffing material 30 and the bag lining 20 to be moved or shifted around and to generally conform, at least partially, to the upper portion of the person's body that is wearing the costume 10.

From the foregoing discussion, it is seen that the present invention presents a costume of a unique design and which includes a construction that yields a robust or plump appearance to the costume. This is achieved by providing a lining structure within a top portion of the costume where the lining is stuffed with a stuffing material that adds thickness and size to the upper portion of the costume. In addition, the costume is easily placed on and removed from a person by the provision of a side opening that extends from the neck opening downwardly through one side area of the costume and wherein the side opening is provided with a fastener such as a zipper that provides for opening and closing the side opening.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A costume comprising:

a. a garment including a top, bottom, an interior area and an outer area;

b. the top including a front area, back area, a pair of side areas, a neck opening, and a pair of arm openings;

c. the outer area of the garment including a costume design;

d. a bag lining secured at multiple points within the interior of the top and including an interior;

e. a stuffing material contained within the interior of the bag lining such that when worn the stuffing material imparts a plump appearance to the costume;

f. a side opening formed in one side area of the top and extending from the neck opening downwardly through a portion of one side area; and g. at least one fastener associated with the side opening formed in a side area of the top for opening and closing the same.

2. The costume of claim 1 wherein the fastener includes a zipper that extends down a portion of the one side area.

3. The costume of claim 1 including a supporting stitch segment extending around a substantial portion of the top for securing the bag lining to the top.

4. The costume of claim 3 wherein the stitch segment extends around a substantial portion of the neck opening.

5. The costume of claim 3 wherein the stitch segment extends around both arm openings of the top.

6. The costume of claim 3 wherein the stitch segment extends adjacent both sides of the opening formed in the side area of the top.

7. The costume of claim 3 wherein the stitch segment includes a series of separate stitch segments that secure the bag lining to various areas of the top including one stitch segment that extends around the neck opening, one stitch segment that extends around each of the arm openings, and a pair of stitch segments that extend on both sides of the side opening formed down one side area of the top.

8. The costume of claim 1 wherein the bottom includes two legs.

9. The costume of claim 1 wherein the top includes two sleeves that extend outwardly from the arm openings.

10. The costume of claim 1 including a tail extending from the costume.

11. The costume of claim 1 wherein the bag lining includes a two-ply lining that extends around a substantial portion of the top and includes an enclosed bottom trough.

12. The costume of claim 11 wherein the two-ply bag lining includes a top edge that is secured to an upper portion of the top in such a fashion that the two-ply bag lining is suspended, in part at least, from the upper portion of a top.

13. A costume for being worn by a person, comprising:

a. a garment including a top that extends from the shoulders of a person downwardly to at least approximately the waist of a person;

b. the garment including an outer area that is provided with a costume design;

c. the top including an interior area, a neck opening, and a pair of arm openings;

d. a bag lining secured to the garment, disposed interiorly of the top, and suspended within the interior area of the top, wherein the bag lining is of a two-ply construction and extends substantially around the top, and wherein the bag lining is secured to the top by a stitch segment that extends around the neck opening and by a pair of stitch segments that extend around the arm openings; and e. a stuffing material contained within the interior of the bag lining such that when worn by the person the stuffing material imparts a plump appearance to the costume.

14. The costume of claim 13 wherein the top includes a pair of side areas and wherein there is provided an opening that extends downwardly from the neck opening through one of the side areas and wherein the bag lining is secured by a pair of stitch segments disposed on opposites sides of the side opening.

15. The costume of claim 13 wherein the top includes a neck opening and a pair of side areas and wherein there is provided a side opening that extends from the neck opening down and through one side area; and wherein there is provided at least one fastener for opening and closing the side opening.

16. The costume of claim 15 wherein the garment includes a bottom having a pair of legs.

17. The costume of claim 16 including a tail.

18. A costume for being worn by a person, comprising:

a. a garment including a top that extends from the shoulders of a person downwardly to at least approximately the waist of a person and a bottom having a pair of legs, wherein the top includes a neck opening and a pair of side areas and wherein there is provided a side opening that extends from the neck opening through one of side area; and wherein there is provided at least one fastener for opening and closing the side opening, and;

b. the garment including an outer area that is provided with a costume design;

f. the top including an interior area;

g. a bag lining secured to the garment and disposed interiorly of the top;

h. a stuffing material contained within the interior of the bag lining such that when worn by the person the stuffing material imparts a plump appearance to the costumed; and i. a tail disposed on an outer surface of the garment.

19. The costume of claim 18 wherein the bag lining is suspended within the interior area of the top.

20. The costume of claim 19 wherein the bag lining is of a two-ply construction and extends substantially around the top.

21. The costume of claim 20 wherein the top includes a neck opening and a pair of arm openings, and wherein the bag lining is secured to the top by a stitch segment that extends around the neck opening and by a pair of stitch segments that extend around the arm openings.

22. The costume of claim 21 wherein the top includes a pair of side areas and wherein there is provided an opening that extends downwardly from the neck opening through one of the side areas and wherein the bag lining is secured by a pair of stitch segments disposed on opposites sides of the side opening.

* * * * *